US008561986B2

(12) United States Patent
Kozaki et al.

(10) Patent No.: US 8,561,986 B2
(45) Date of Patent: Oct. 22, 2013

(54) SHEET CONVEYING DEVICE

(75) Inventors: Daisuke Kozaki, Kiyosu (JP); Hiroshi Shiomi, Nagoya (JP); Ai Yamazaki, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/369,037

(22) Filed: Feb. 8, 2012

(65) Prior Publication Data

US 2012/0248681 A1 Oct. 4, 2012

(30) Foreign Application Priority Data

Mar. 31, 2011 (JP) ..... 2011-079515

(51) Int. Cl.
*B65H 5/02* (2006.01)

(52) U.S. Cl.
USPC ..... 271/274; 271/314

(58) Field of Classification Search
USPC ..... 271/264, 274, 314
See application file for complete search history.

(56) References Cited

U.S. PATENT DOCUMENTS

| | | | | |
|---|---|---|---|---|
| 2007/0210512 | A1 | 9/2007 | Sakakibara et al. | |
| 2010/0244360 | A1 * | 9/2010 | Yamamoto | 271/10.01 |

FOREIGN PATENT DOCUMENTS

| | | | | |
|---|---|---|---|---|
| JP | H02-144363 | A | | 6/1990 |
| JP | H07-330187 | A | | 12/1995 |
| JP | 2002-274689 | A | | 9/2002 |
| JP | 2007-238252 | A | | 9/2007 |
| JP | 2008156108 | A | * | 7/2008 |
| JP | 4497751 | B2 | | 7/2010 |

OTHER PUBLICATIONS

Translation of JP 2008-156108 A.*
Japan Patent Office, Notice of Reasons for Rejection for Japanese Patent Application No. 2011-079515 (counterpart Japanese patent application), mailed Jan. 22, 2013.

* cited by examiner

*Primary Examiner* — Michael McCullough
(74) *Attorney, Agent, or Firm* — Baker Botts L.L.P.

(57) ABSTRACT

A sheet conveying device includes a cover member made of resin and partially defining a conveying path, a roller member rotatably disposed on the cover member and configured to convey a sheet along the conveying path, an urging member disposed between the cover member and a rotary shaft of the roller member and urging the roller member toward the conveying path while one end of the urging member contacts the rotary shaft, and a plate member made of metal and disposed between the cover member and the urging member. The plate member includes a first segment extending along the cover member and contacting the other end of the urging member, a second segment extending from an edge of the first segment in a direction toward the conveying path, and a third segment extending from an edge of the second segment in a direction different from the second segment extending direction.

13 Claims, 9 Drawing Sheets

SHEET CONVEYING DEVICE

CROSS REFERENCE TO RELATED APPLICATION

This application claims priority from Japanese Patent Application No. 2011-079515, filed on Mar. 31, 2011, the entire disclosure of which is incorporated herein by reference.

BACKGROUND OF THE INVENTION

1. Field of the Invention

The present invention relates to a sheet conveying device configured to convey a sheet along a conveying path.

2. Description of Related Art

A known multi-function device and a known scanning device each comprise a sheet conveying device. The sheet conveying device is configured to convey sheets from a sheet stacking location along a conveying path such that images on the sheets are sequentially scanned.

A known sheet conveying device comprises a cover member made of resin and defining a part of a sheet conveying path, and a roller member disposed on the cover member and configured to rotate and convey a sheet along the sheet conveying path. The sheet conveying device further comprises an urging member disposed between the cover member and a shaft of the roller member. The urging member urges the roller member by contacting, at its one end, the roller member and, at its other end, the cover member, such that the roller member reliably contacts the sheet. Thus, when the roller member rotates, the roller member reliably conveys the sheet.

There has recently been a demand for compact and slim sheet conveying devices. In order to meet such a demand, it is conceivable to reduce the thickness of the cover member of the above-described sheet conveying device. In this case, however, the cover member may deform due to urging force of the urging member because one end of the urging member contacts the cover member. Because the cover member of the above-described sheet conveying device defines an outer surface of the sheet conveying device, such deformation may deteriorate the appearance of the device.

SUMMARY OF THE INVENTION

Therefore, a need has arisen for a sheet conveying device that overcomes these and other shortcomings of the related art and is configured to be slim while a cover member made of resin is prevented from deforming due to urging force of an urging member.

According to an embodiment of the invention, a sheet conveying device comprises a cover member made of resin and defining a part of a conveying path along which a sheet is conveyed, a roller member rotatably disposed on a conveying path facing side of the cover member and configured to convey the sheet along the conveying path, an urging member disposed between the cover member and a rotary shaft of the roller member and urging the roller member toward the conveying path in a state where one end of the urging member contacts the rotary shaft of the roller member, and a plate member made of metal and disposed between the cover member and the urging member. The plate member comprises a first segment extending along a surface of the conveying path facing side of the cover member and contacting an other end of the urging member, a second segment extending from an edge of the first segment in a direction toward the conveying path, and a third segment extending from an edge of the second segment in a direction different from the direction in which the second segment extends.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Figure 1:
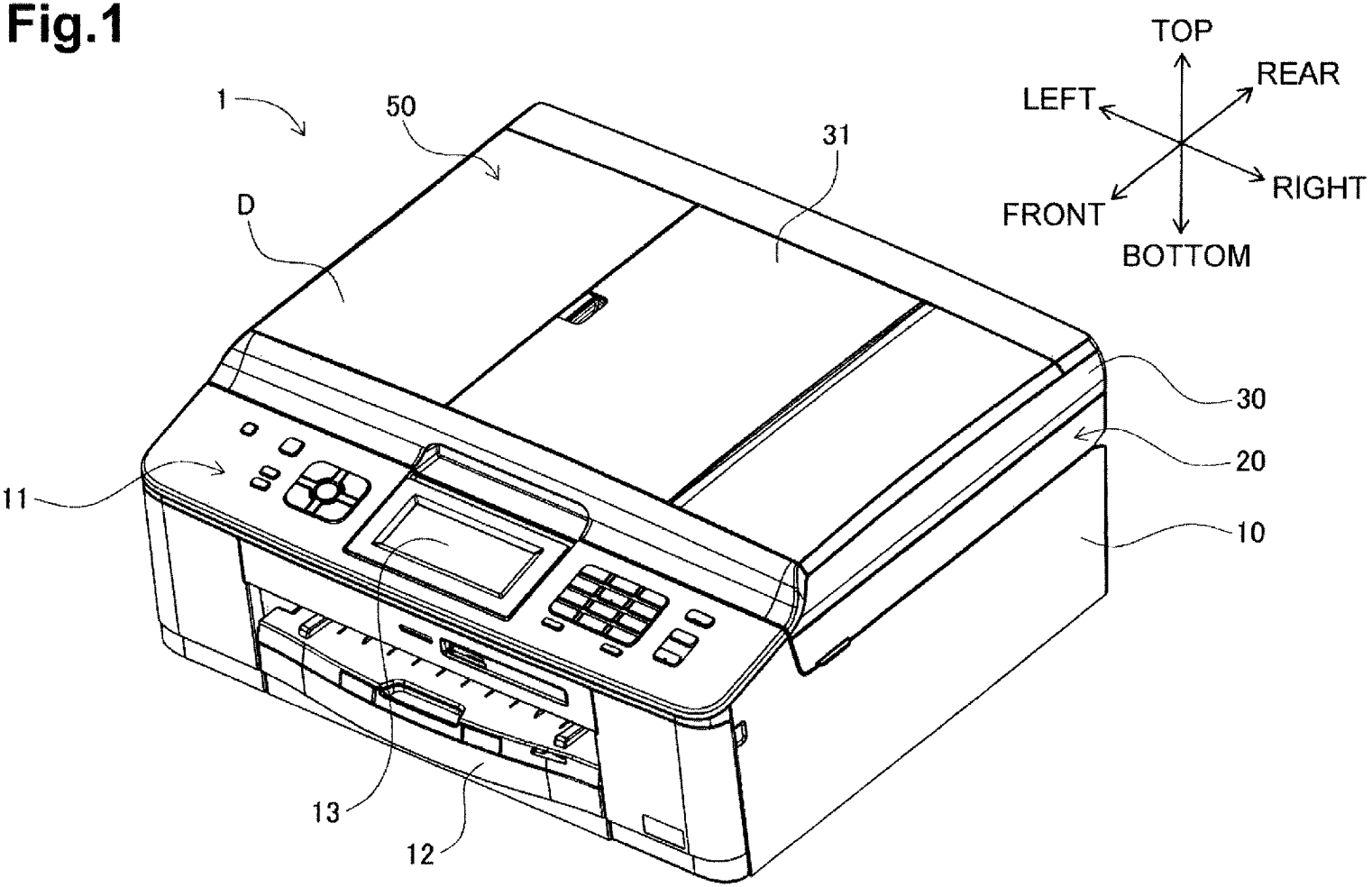
FIG. 1 is an external perspective view of a multi-function device according to an embodiment of the invention.

Embodiments of the invention and their features and technical advantages may be understood by referring to FIGS. 1-9, like numerals being used for like corresponding parts in the various drawings.

A sheet conveying device according to an embodiment of the invention, e.g., a sheet conveying unit 50 of a multi-function device 1, will be described in detail while referring to the drawings.

A general structure of the multifunction device 1 according to an embodiment of the invention will be described in detail while referring to the drawings.

In the following description, directions are defined when the multi-function device is disposed in an orientation in which it is intended to be used. In FIG. 1, bottom left is defined as front, and top right is defined as rear. Left and right are defined when the multi-function device 1 is viewed from the front and, in FIG. 1, top left is defined as left, and bottom right is defined as right.

As shown in FIG. 1, the multi-function device 1 comprises a housing 10 and a sheet cover 30. The housing 10 stores therein various components for performing various functions (a scanning function, a facsimile function, and a printing function).

The housing 10 comprises, at the front top thereof, an operation panel 11 including operating portions, and a liquid display 13 for displaying various information.

The operation panel 11 is used to input various instructions to the multi-function device 1. A sheet cassette 12 is removably attached to the front of the housing 10. The sheet cassette 12 is configured to store therein a stack of recoding media, e.g., sheets.

Figure 2:
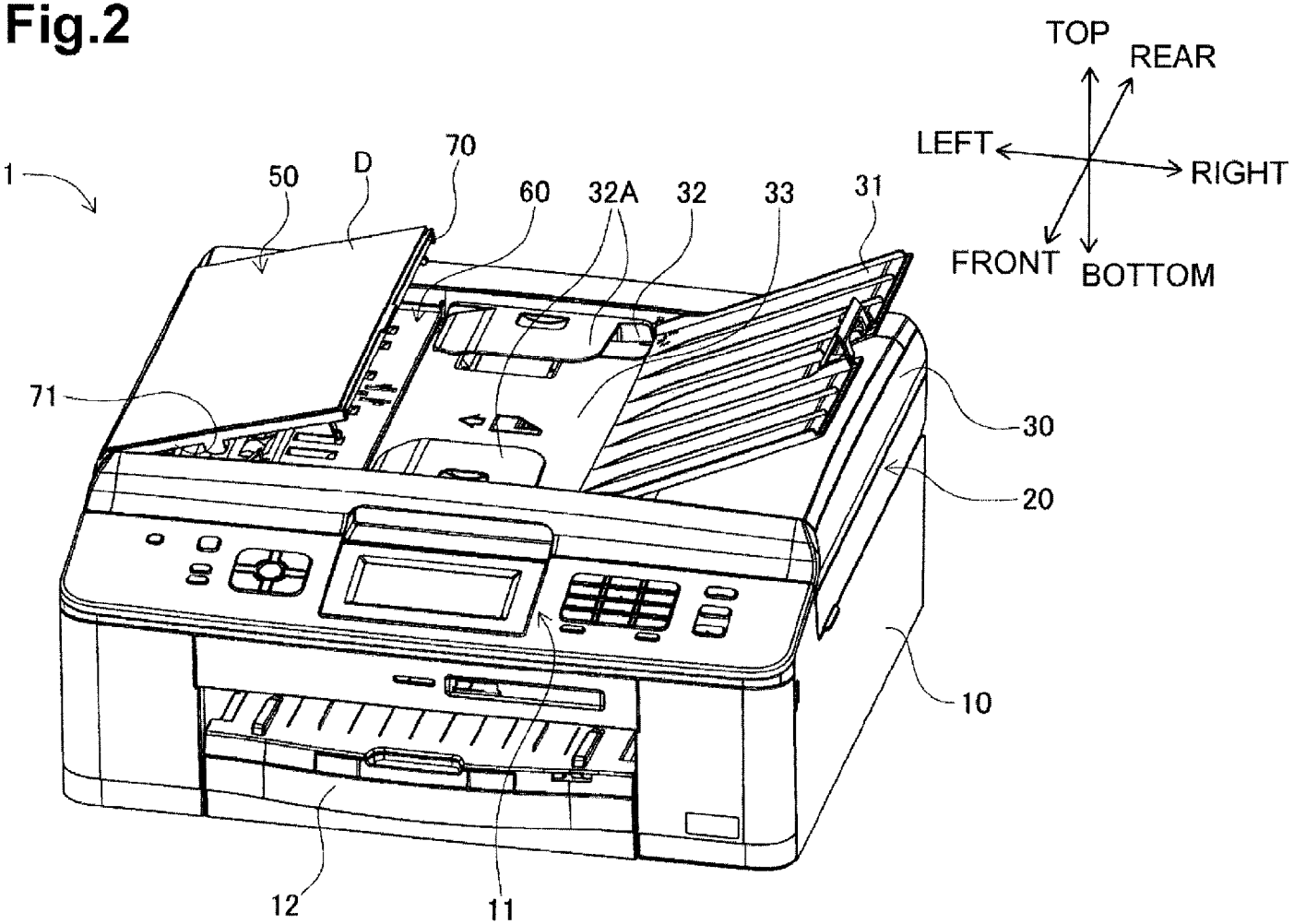
FIG. 2 is an external perspective view of the multi-function device in which a top cover and a cover tray are pivoted.
Figure 3:
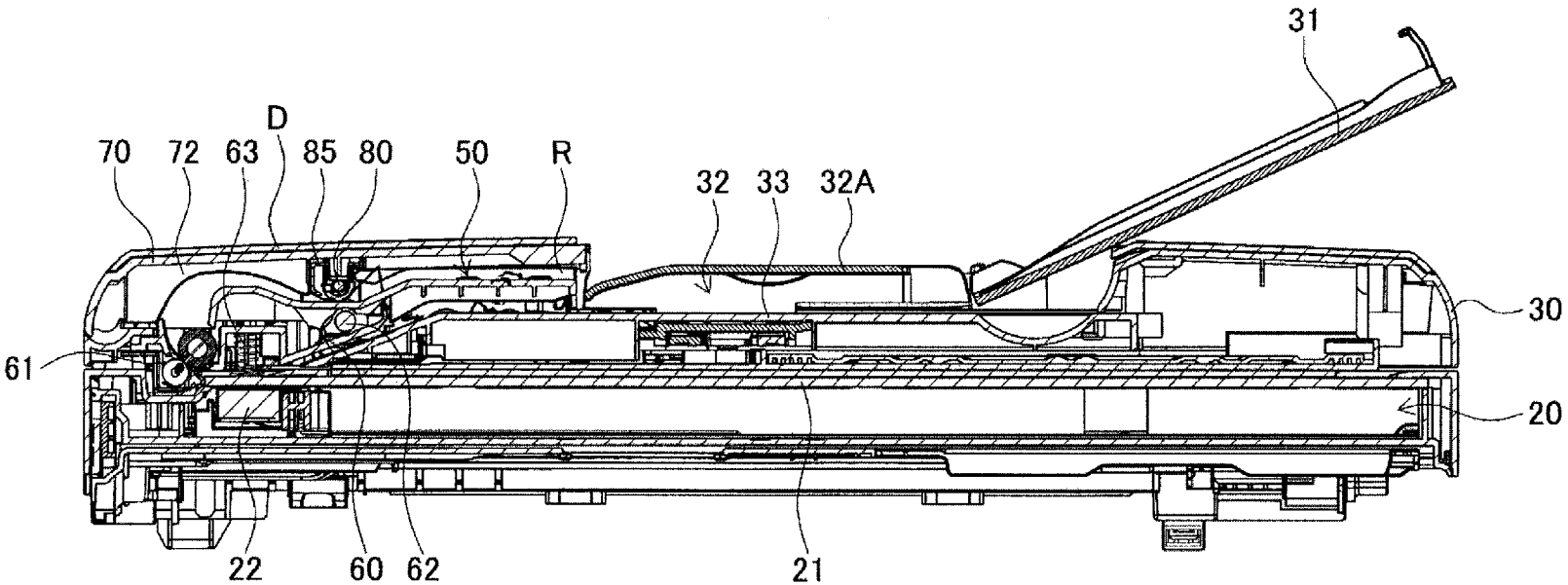
FIG. 3 is a cross-sectional view showing a structure of a sheet cover that comprises a sheet conveying unit, according to an embodiment of the invention.

As shown in FIGS. 1 to 3, the housing 10 comprises, at the top thereof, a scanner unit 20. As shown in FIG. 3, the scanner unit 20 comprises a contact glass 21 served as a document holder, an image sensor 22, a slide shaft, and a motor. The contact glass 21 is a so-called platen glass and has a rectangular shape larger than A4 size. A long side of A4 size extends in a left-right direction of the housing 10.

The image sensor 22 is a so-called contact image sensor (CIS) and is configured to scan an image of a document sheet placed on the contact glass 21. The image sensor 22 has a scanning range, which corresponds to a length of a short side of A4 size, in a scanning direction (i.e., a front-rear direction of the housing 10). The image sensor 22 is held by the slide shaft extending in the left-right direction of the housing 10 so as to be slidable in the left-right direction within a predetermined range (a range corresponding to the long side of A4 size). In the multi-function device 1, based on control of a motor by a controller, the image sensor 22 slides along the slide shaft and scans an image of a document sheet placed on the contact glass 21.

The controller comprises a central processing unit (CPU), a read only memory (ROM), and a random access memory (RAM) and controls, as a control center, various functions of the multi-function device 1. The controller is configured to execute controls desired by the user, based on inputs by the user from the operation panel 11. The controller is further configured to control the liquid display 13 to display various information based on inputs by the user from the operation panel 11 and results of computation.

A facsimile unit is configured to transmit an image of a document sheet scanned by the scanner unit 20 via a network to a recipient desired by the user. The facsimile unit is further configured to receive data via the network. The controller controls an image forming unit to output the data received by the facsimile unit onto a sheet fed from the sheet cassette 1.

The image forming unit is configured to print out input image data on a sheet fed from the sheet cassette 12, based on control by the controller. The multi-function device 1 performs a copying function by controlling the image forming unit to process image data of an image scanned by the scanner unit 20. The multi-function device 1 performs a printing function by controlling the image forming unit to process print data input via the network.

A sheet cover 30 is configured to pivot about an axis located at the rear top end of the housing 10 so as to be opened and closed. As shown in FIG. 3, when the sheet cover 30 is closed, the sheet cover 30 covers an upper surface of the housing 10, (i.e., the contact glass 21). Thus, when the sheet cover 30 is closed, the sheet cover 30 securely holds a document sheet set on the contact glass 21.

The sheet cover 30 comprises a cover tray 31, sheet guide members 32, a sheet guide surface 33, and a sheet conveying unit 50 (i.e., an automatic document feeder (ADF)). As shown in FIGS. 1 to 3, the cover tray 31 is configured to pivot about a pivot shaft formed at an end of the cover tray 31 and located at a central portion of an upper surface of the sheet cover 30. As shown in FIG. 1, when the cover tray 31 is closed (hereinafter, this position is referred to as a closed position), the cover tray 31 defines an outer surface of the sheet cover 30 which is flush with an outer surface of the sheet conveying unit 50 (i.e., a surface of a cosmetic cover D).

A surface of the cover tray 31 which becomes an outer surface of the sheet cover 31 when the cover tray 31 is in the closed position is referred to as a first surface, and a surface opposite to the first surface is referred to as a second surface. The second surface of the cover tray 31 is an inner surface of the cover tray 31 when the cover tray 31 is in the closed position.

As shown in FIGS. 2 and 3, when the cover tray 31 is pivoted by a predetermined degree to an operating position, a pair of sheet guide members 32 and the sheet guide surface 33 are exposed outwardly. Each of the sheet guide members 32 is slidable in a front-rear direction on the sheet guide surface 33 which is formed below the cover tray 31. The sheet guide members 32 are linked by a linking mechanism such that one of the sheet guide members 32 slides in one direction while the other of the sheet guide members 32 slides in a direction opposite to the one direction. By operating one of the sheet guide members 32, the sheet guide members 32 slide close to or away from each other, and a distance between the sheet guide members 32 can be adjusted. By operating the sheet guide members 32, a document sheet is properly positioned between the sheet guide members 32 and is prevented from skewing relative to a sheet conveying direction.

The sheet guide members 32 each comprise a partition plate 32A. The partition plate 32A is formed above the sheet guide surface 33 so as to be spaced by a predetermined distance from the sheet guide surface 33.

As shown in FIGS. 2 and 3, when the cover tray 31 is in the operating position, the second surface of the cover tray 31 faces upward and is inclined downward toward the sheet guide surface 33. In this state, document sheets can be stacked on the second surface of the cover tray 31.

A recess is formed below the pivot shaft of the cover tray 31 such that a pivot shaft-side end of the cover tray 31 passes a space defined by the recess. The recess allows the cover tray 31 to pivot about the pivot shaft smoothly. The recess allows the sheet guide surface 33 and the pivot shaft of the cover tray 31 to be vertically close to each other. This makes the sheet cover 30 slim.

The sheet conveying unit 50 is integrally formed with a left side portion of the sheet cover 30. The sheet conveying unit 50 is configured to sequentially feed document sheets placed on the second surface of the cover tray 31 and the sheet guide surface 33. The sheet conveying unit 50 is configured to separate the fed document sheets one by one, and to convey the separated document sheet along a conveying path R (shown in FIG. 4). The scanner unit 20 of the multi-function device 1 scans an image of the document sheet while the sheet conveying unit 50 conveys the document sheet.

As shown in FIG. 3, the conveying path R extends from the second surface of the cover tray 31 and the sheet guide surface 33, has a U shape, and extends to surfaces of the partition plates 32A of the sheet guide members 32. The conveying path R extends along a left-right direction of the sheet conveying unit 50. In this embodiment, a direction directed from the sheet guide surface 33 toward the partition plates 32A along the conveying path R is referred to as a sheet conveying direction. A width direction of a document sheet refers to a direction of the width of a document sheet conveyed along the conveying path R (i.e., a front-rear direction of the sheet conveying unit 50.

As shown in FIGS. 1 to 4, the sheet conveying unit 50 comprises a unit main body 60 and a top cover 70. The unit main body 60 is disposed at a lower portion of the sheet conveying unit 50 and functions as a main portion of the sheet conveying unit 50. The top cover 70 is disposed at an upper portion of the sheet conveying unit 50 and is configured to pivot about a left end of the sheet conveying unit 50, as shown in FIGS. 1 to 5. An inner surface (lower surface) of the top cover 70 and an upper surface of the unit main body 60 define a part of the conveying path R.

The cosmetic cover D is removably attached to an outer surface of the top cover 70 (i.e., an upper surface of the sheet conveying unit 50). The cosmetic cover D is made of transparent resin and cooperates with an upper surface of the top cover 70 to hold a cosmetic sheet having a predetermined pattern. The pattern of the cosmetic sheet is visible through the cosmetic cover D. The cosmetic sheet can be replaced with a cosmetic sheet having a different pattern by removing the cosmetic cover D from the top cover 70.

Figure 4:
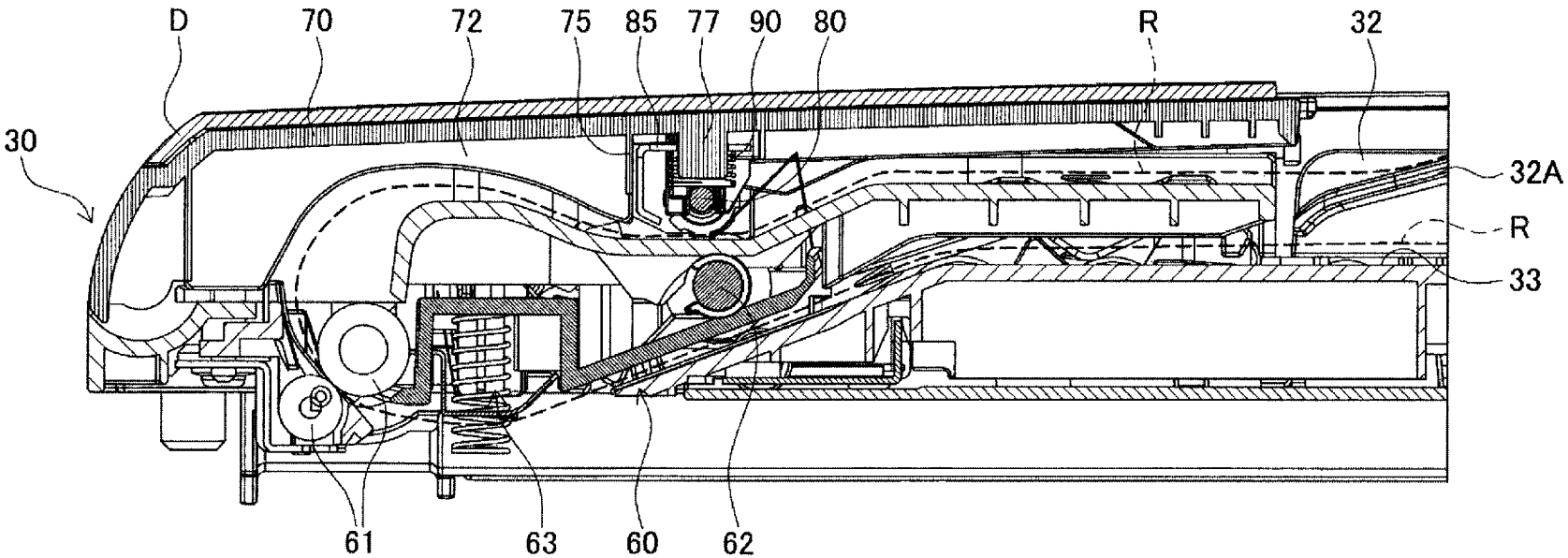
FIG. 4 is an enlarged cross-sectional view showing a structure of the sheet conveying unit.

As shown in FIGS. 3 and 4, the unit main body 60 comprises a conveying roller pair 61, a driving conveying roller 62, and a sheet holder 63. The unit main body 60 defines, inside thereof, a part of the conveying path R. As described above, the upper surface of the unit main body 60 and the inner surface of the top cover 70 define a part of the conveying path R that continues from a part of the conveying path defined inside of the unit main body 60.

As shown in FIGS. 3 and 4, the conveying roller pair 61 comprises a pair of rollers which are opposed to each other via the conveying path R and are controlled by the controller to rotate while sandwiching a document sheet conveyed along the conveying path R. The driving conveying roller 62 is disposed along the upper surface of the unit main body 60 and is configured to rotate and convey the document sheet conveyed along the conveying path R, which is formed along the upper surface of the unit main body 60, toward upper surfaces of the partition plates 32A of the sheet guide members 32.

The sheet holder 63 is disposed upstream of the conveying roller pair 61 in the sheet conveying direction and is configured to press the document sheet conveyed along the conveying path R against the contact glass 21. When the scanner unit 20 of the multi-function device 1 scans an image of the document sheet conveyed by the sheet conveying unit 50, the image sensor 22 is located below the sheet holder 63. The scanner unit 20 scans, via the contact glass 21, the image of the document sheet passing below the sheet holder 63. At this time, because the document sheet is pressed by the sheet holder 63 against the contact glass 21, the scanner unit 20 can scan the image at a high precision.

Figure 5:
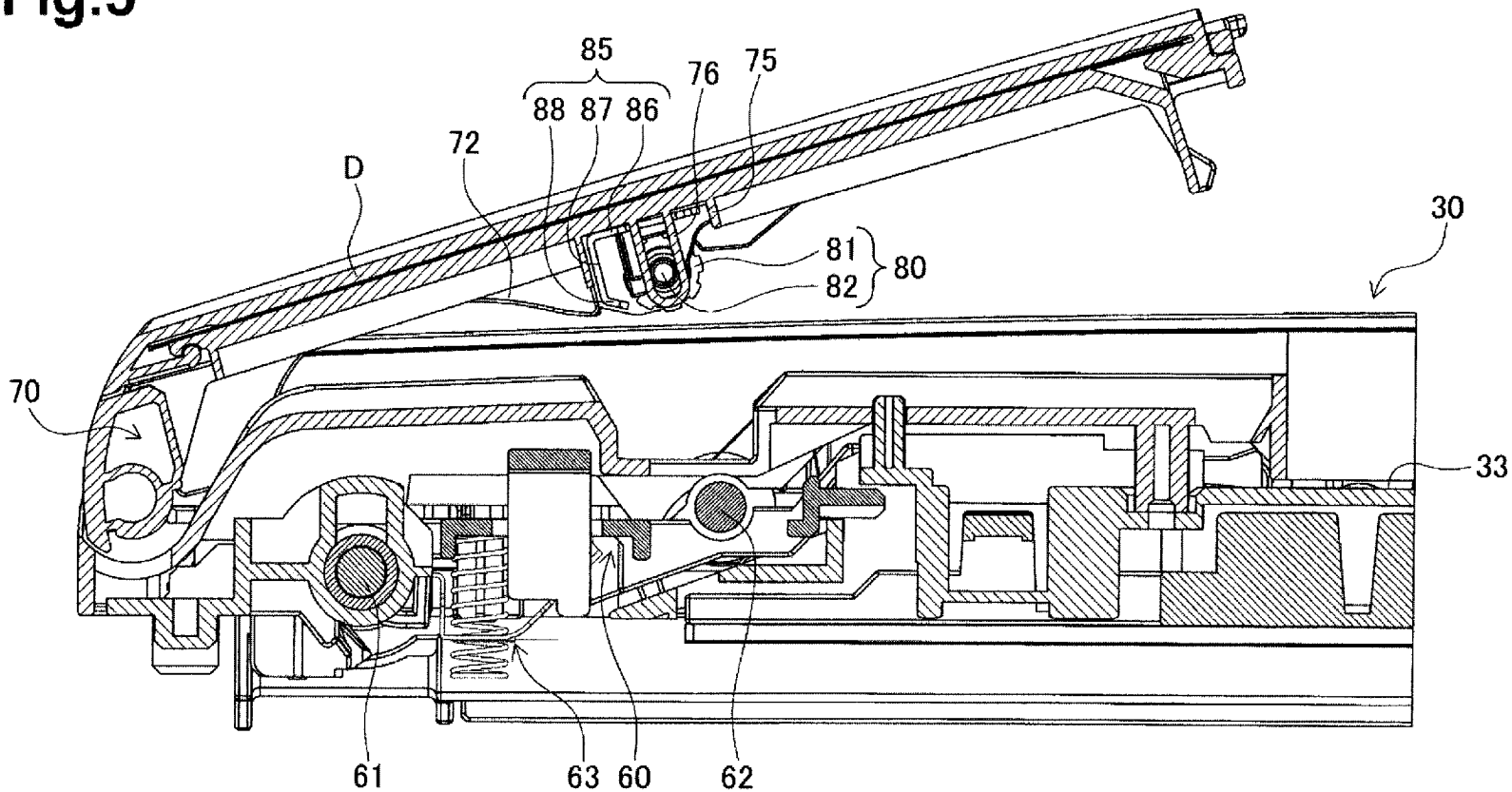
FIG. 5 is an enlarged cross-sectional view of the sheet conveying unit in a state where the top cover is pivoted.
Figure 6:
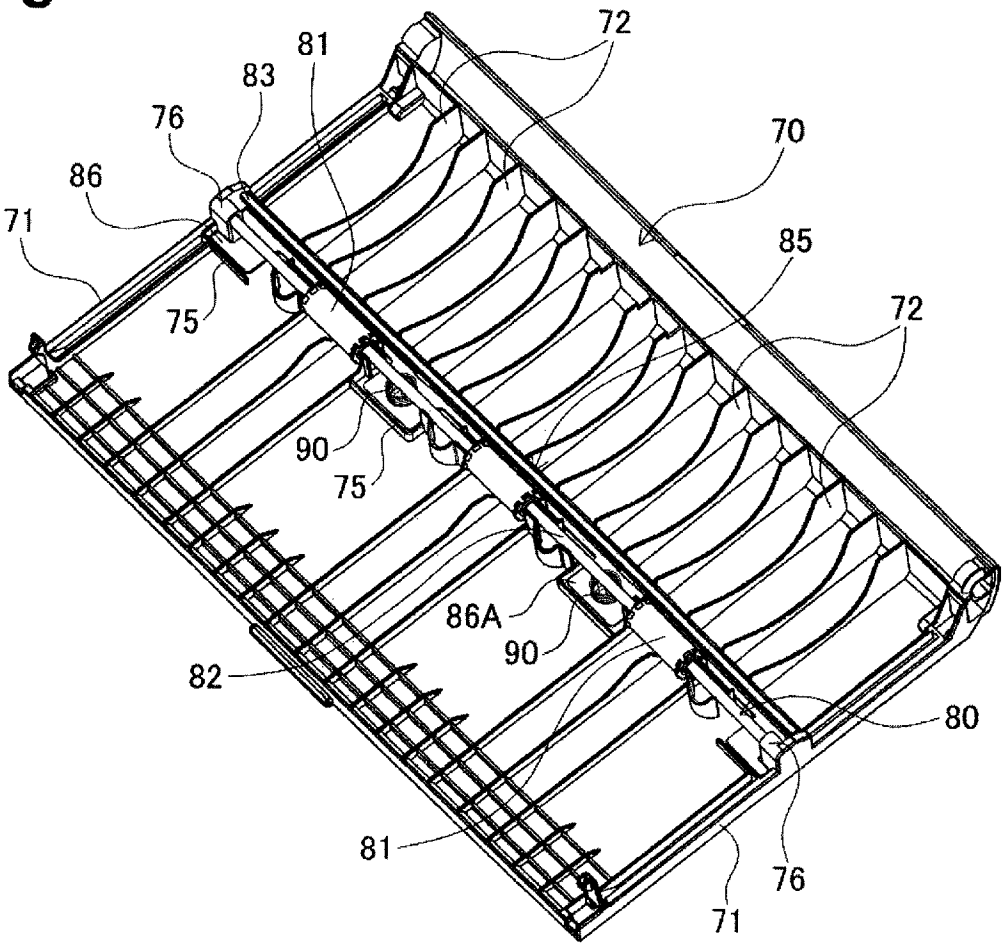
FIG. 6 is an external perspective view showing a structure of the top cover.

As described above, the top cover 70 is disposed at the upper portion of the sheet conveying unit 50 and is configured to pivot about the left end of the sheet conveying unit 50. The inner surface (lower surface) of the top cover 70 and the upper surface of the unit main body 60 define a part of the conveying path R. As shown in FIGS. 4 to 6, the top cover 70 comprises side wall portions 71, guide ribs 72, and a positioning portion 75. A driven conveying roller 80, a plate member 85, and coil springs 90 are attached to the top cover 70.

Figure 7:
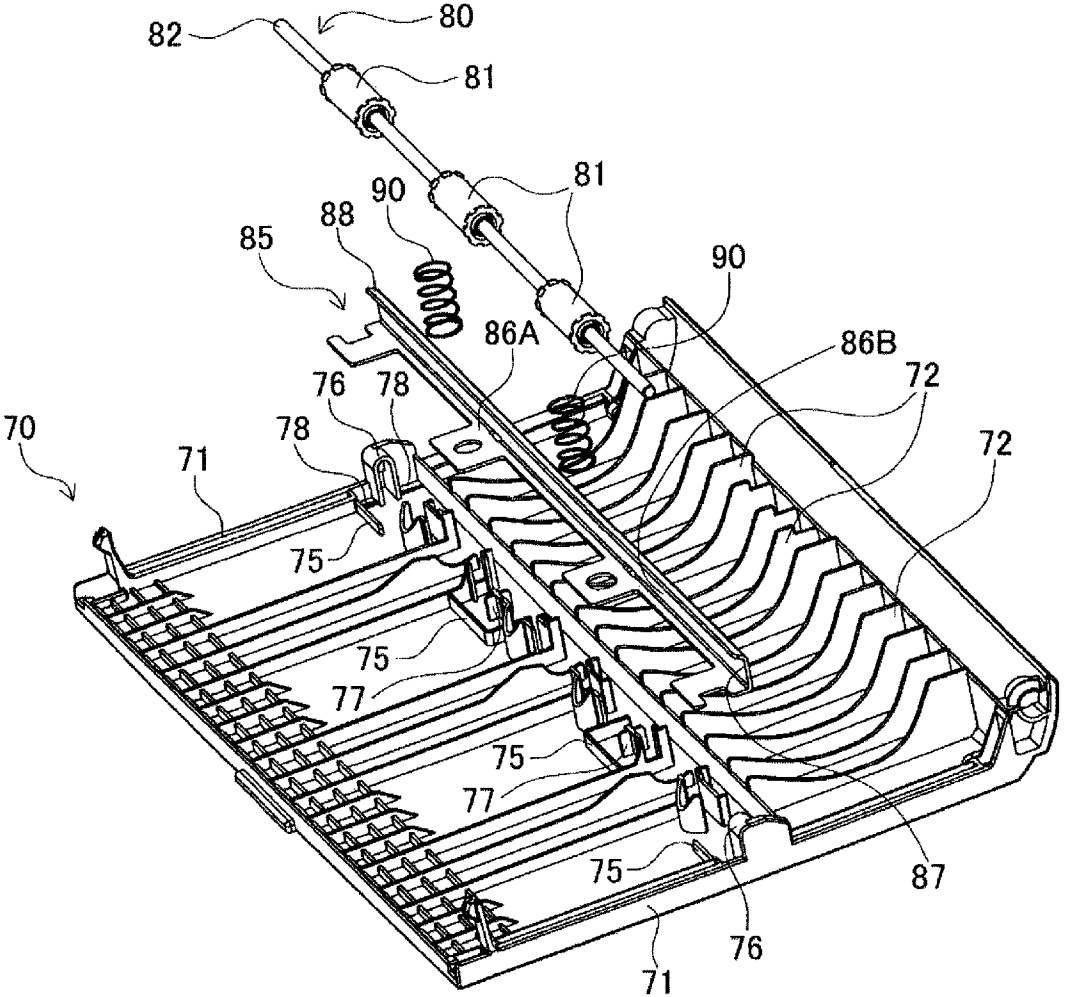
FIG. 7 is a exploded perspective view of the top cover.

As shown in FIGS. 6 and 7, the side wall portions 71 are disposed along a front end and a rear end of the top cover 70 (along a bottom right end and a top left end of the top cover 70 shown in FIGS. 6 and 7), and project toward the conveying path R (upward in FIGS. 6 and 7). The side wall portions 71 each have rigidity greater than that of a remaining portion (e.g., a central portion) of the top cover 70.

As shown in FIGS. 6 and 7, the guide ribs 72 are arranged at predetermined intervals on the inner surface of the top cover 70 and project toward the conveying path R. An end face of each guide rib 72 has an arc shape. The document sheet conveyed along the conveying path R contacts the end faces of the guide ribs 72 and are guided along the arc-shaped end faces of the guide ribs 72 toward the driving conveying roller 62. The guide ribs 72 can reduce a contact area between the sheet conveying unit 50 and the document sheet. Thus, the sheet conveying unit 50 can convey the document sheet along the conveying path R while reducing a friction between the sheet conveying unit 50 and the document sheet.

The positioning portion 75 of the top cover 70 are opposed to a position where the driving conveying roller 62 is disposed in the unit main body 60. The positioning portion 75 comprise ribs projecting so as to define, in the top cover 70, a predetermined area that extends in the width direction of the document sheet (a front-rear direction of the multi-function device 1). The positioning portion 75 is configured to position a plate member 85, which is described later, at a predetermined position of the top cover 70.

Figure 9:
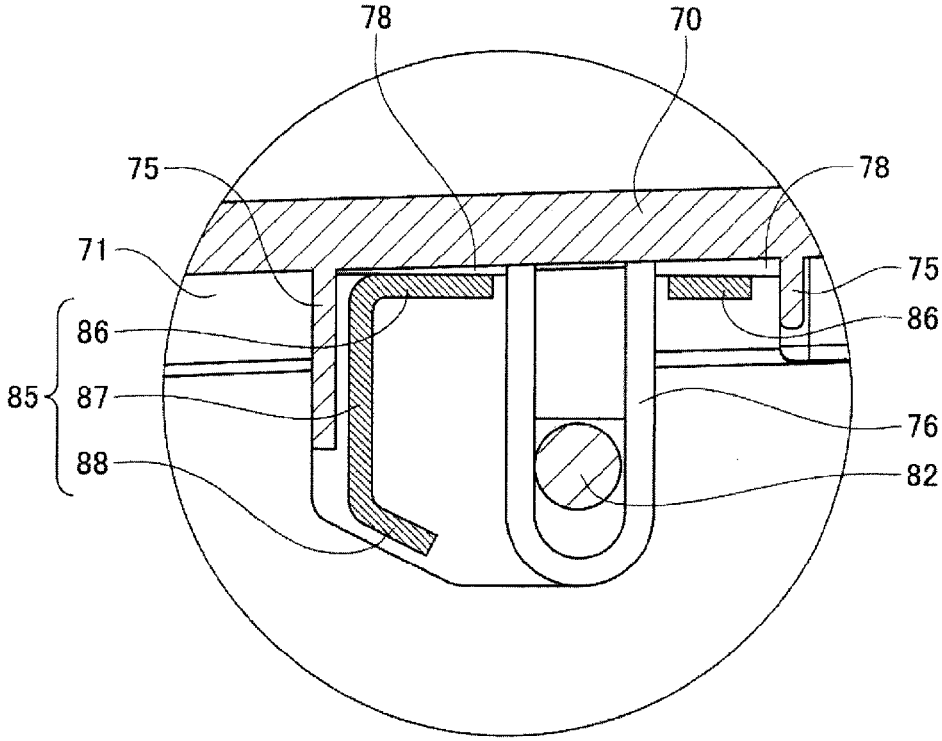
FIG. 9 is a cross-sectional view showing a shaft holding portion and its vicinity.

Shaft holding portions 76, spring holding portions 77, and reinforcing ribs 78 are formed in the positioning portion 75. As shown in FIGS. 6 and 7, the shaft holding portions 76 project in proximity to and along the side wall portions 71, respectively. As shown in FIG. 9, each of the shaft holding portions 76 has a groove for holding a corresponding one of opposite ends of a roller shaft 82 of the driven conveying roller 80.

As shown in FIGS. 6 and 7, two spring holding portions 77 are disposed in a projecting manner on the top cover 70 at a predetermined interval in the width direction of the conveying path R (the front-rear direction of the multi-function device 1). As shown in FIG. 4, each of the spring holding portions 77 is inserted into a corresponding coil spring 90 thereby to position and hold the coil spring 90.

As shown in FIG. 7, each of the reinforcing ribs 78 is formed in proximity to a corresponding side wall portion 71 and a corresponding shaft holding portion 76, and projects slightly toward the conveying path R along the corresponding side wall portion 71.

Structures of the driven conveying roller 80, the plate member 85, and the coil springs 90, which are attached to the top cover 70, will be described in detail while referring to the drawings. As shown in FIGS. 4 and 5, the driven conveying roller 80 is rotatably disposed on the top cover 70 so as to oppose the driving conveying roller 62 via the conveying path R. The driven conveying roller 80 cooperates with the driving conveying roller 62 to convey the document sheet downstream along the conveying path R.

The driven conveying roller 80 comprises roller bodies 81 and a roller shaft 82. The roller bodies 81 contact the document sheet conveyed along the conveying path R and are formed by a cylindrical rubber or the like. The roller shaft 82 is a rotary shaft of the driven conveying roller 80 and extends in the width direction of the conveying path R. As shown in FIGS. 6 and 7, opposite ends of the roller shaft 82 are rotatably held by the shaft holding portions 76, respectively. Three roller bodies 81 are disposed around the roller shaft 82 at predetermined intervals along the width direction of the conveying path R.

Figure 8:
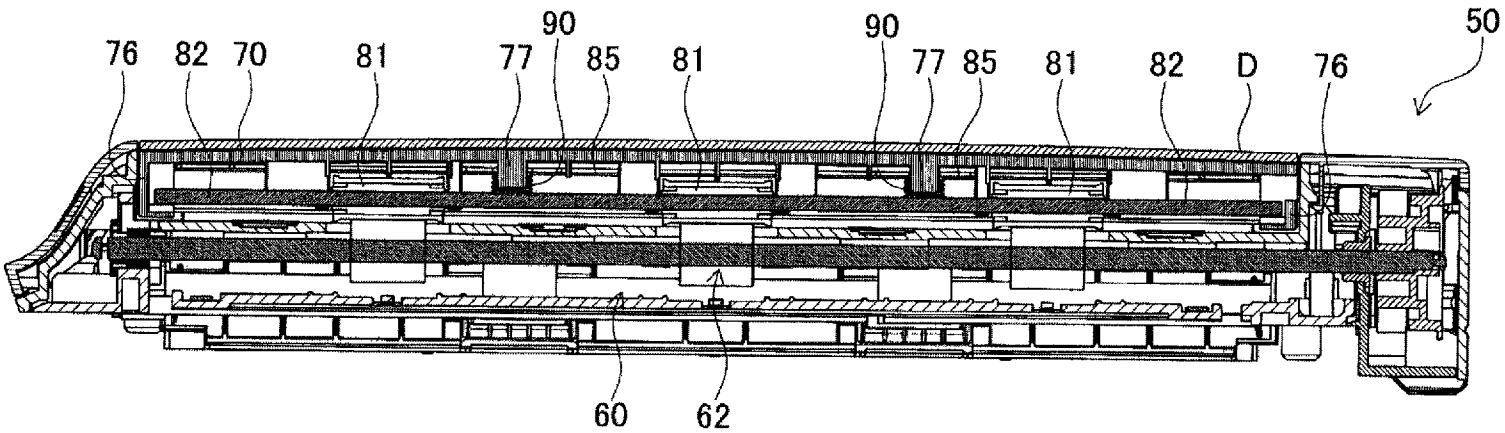
FIG. 8 is a cross-sectional view of the sheet conveying unit taken along a roller shaft.

As shown in FIGS. 6 to 8, the coil springs 90 are urging members configured to urge the driven conveying roller 80 toward the conveying path R, and are disposed between the top cover 70 and the roller shaft 82. As described above, the coil springs 90 are inserted into the spring holding portions 77, respectively, thereby to be positioned at predetermined two locations.

The plate member 85 is a plate-like member made of metal and has a first segment 86, a second segment 87, and a third segment 88. As shown in FIGS. 6 and 7, the plate member 85 is disposed in the positioning portion 75 of the top cover 70. In the positioning portion 75, the first segment 86 is interposed between the coil springs 90 and the top cover 70. The first segment 86 is a flat segment of the plate member 85 and extends along and in contact with the inner surface of the top cover 70. The first segment 86 comprises extending portions 86A and a reinforcing portion 86B. The extending portions 86A positionally correspond to the spring holding portions 77 in the positioning portion 75 and extend from the second segment 87 by a predetermined distance. Thus, as shown in FIGS. 6 and 8, the extending portions 86A each contacts one end of a corresponding coil spring 90. The reinforcing portion 86B is a remaining portion of the first segment 86 other than the extending portions 86A and extends from the second segment 87 by a distance less than the predetermined distance.

As shown in FIGS. 5 to 9, the second segment 87 is a flat segment of the plate member 85 and extends from an upstream edge of the first segment 86 (i.e., the extending portion 86A and the reinforcing portion 86B) in the sheet conveying direction toward the conveying path R. The second segment 87 extends to a position proximate to the conveying path R (e.g., a position proximate to the end face of each guide rib 72), and does not extend beyond the sheet conveying path R. The third segment 88 is a flat segment of the plate member 85 and extends, along the conveying path R, from a conveying path-side edge of the second segment 87. As shown in FIGS. 4 and 5, the third segment 88 extends in a direction defined by the projecting ends of the guide ribs 72 proximate to the positioning portion 75. An extending end of the third segment 88 extends to a position proximate to each roller body 81 and guides the document sheet conveyed from an upstream side of the conveying path R to a nip position between each roller body 81 and the driving conveying roller 62.

How to attach the driven conveying roller 80, the plate member 85, and the coil springs 90 to the top cover 70 will be described in detail while referring to the drawings. As shown in FIG. 5, the plate member 85 is first attached into the positioning portion 75 of the top cover 70. As described above, because the positioning portion 75 is defined by the ribs, the plate member 85 is positioned in a predetermined position of the top cover 70. As shown in FIG. 7, the extending portions 86A partially constitute the first segment 86 of the plate member 85 and each have a through hole for a corresponding spring holding portion 77. By attaching the plate member 85 to the top cover 70 such that the spring holding portions 77 are inserted into the through holes of the extending portions 86A, the plate member 85 is positioned in the predetermined position of the top cover 70. At this time, the first segment 86 of the plate member 85 contacts the inner surface of the top cover 70 (i.e., a conveying path facing surface of the top cover 70). Specifically, as shown in FIG. 9, when the plate member 85 is in the positioning portion 75, opposite end portions, in the width direction of the document sheet, of the first segment 86 of the plate member 85 contact projecting ends of the reinforcing ribs 78, respectively.

After the plate member 85 is positioned in the positioning portion 75, the coil springs 90 are placed on the spring holding portions 77. Specifically, when the spring holding portions 77 are inserted into the coil springs 90, the coil springs 90 are positioned on the extending portions 86A of the plate member 85. As shown in FIGS. 4, 6, and 8, one end of each coil spring 90, which is positioned by a corresponding spring holding portion, contacts a corresponding extending portion 86A of the plate member 85.

Then, in a state where the plate member 85 and the coil springs 90 are positioned in the positioning portion 75, the driven conveying roller 80 is attached to the top cover 70 via the shaft holding portions 76. As shown in FIG. 6, each spring holding portion 77 is located between the roller bodies 81 and is opposed to the roller shaft 82. Thus, the other end of each coil spring 90 contacts the roller shaft 82 of the driven conveying roller 80.

As shown in FIG. 6, when opposite ends of the roller shaft 82 are fitted into the grooves of the shaft holding portions 76 of the top cover 70, respectively, the shaft holding portions 76 cooperate with the coil springs, which generate urging force to the roller shaft 82, to support the driven conveying roller 80 rotatably. The driven conveying roller 80 is positioned on the conveying path side of the positioning portion 75 and extends along the width direction of the conveying path R.

The driven conveying roller 80 is attached to the top cover 70 such that the roller shaft 82 of the driven conveying roller 80 is held by the shaft holding portions 76 while the roller shaft 82 contacts one end of each coil spring 90 in a state where the other end of each coil spring 90 contacts the first segment 86 of the plate member 85.

The driven conveying roller 80 is attached to the top cover 70 such that the roller shaft 82 is held by the roller holding portions 76 while the roller shaft 82 contacts one end of each coil spring 90 in a state where the other end of each coil spring 90 contacts the first segment 86 of the plate member 85. When the driven conveying roller 80, the plate member 85, and the coil springs 90 are attached to the top cover 70, no extra members, such as screws, are not used. Thus, in the multi-function device 1, a worker can readily assemble, replace, and disassemble the driven conveying roller 80, the plate member 85, and the coil springs relative to the top cover 70.

As typically shown in FIG. 4, in the multi-function device according to the above-described embodiment, because the coil springs 90 are disposed between the roller shaft 82 of the driven conveying roller 80 and the first segment 86 of the plate member 85, the driven conveying roller 80 are urged toward the driving conveying roller 62 via the conveying path R. Consequently, in the multi-function device 1, the roller bodies 81 of the driven conveying roller 80 are reliably brought into contact the document sheet conveyed along the conveying path R and are sandwiched between the driven conveying roller 80 and the driving conveying roller 62. When the driving conveying roller 62 is driven to rotate, the document sheet is conveyed along the conveying path R.

The plate member 85 is made of metal and comprises the first segment 86, the second segment 87, and the third segment 88. The rigidity of the plate member 85 is greater than that of the top cover 70 which is made of resin. Because the urging force of the coil springs 90 is applied to the pate member 85, the top cover 70 can be prevented from deforming. Even when the top cover 70 is made thin, the plate member 85 prevents the top cover 70 from deforming due to the urging force of the coil springs 90. Thus, the multi-function device 1 can be made compact and slim.

As shown in FIG. 4, the third segment 88 of the plate member 85 extends along a direction defined by the projecting ends of the guide ribs 72 proximate to the positioning portion 75. Thus, the third segment 88 functions as a guide for guiding the document sheet downstream along the conveying path R. In the multi-function device 1, the plate member 85 can prevent deformation of the top cover 70 and facilitate a smooth conveyance of the document sheet along the conveying path R.

The third segment 88 of the plate member 85 is disposed adjacent to and upstream, in the sheet conveying direction, of the driven conveying roller 80. In the multi-function device according to the above-described embodiment, the plate member 85 can prevent deformation of the top cover 70. Thus, the positional relation among the plate member 85, the driven conveying roller 80, and the driving conveying roller 62 can be maintained while displacement of the top cover 70 is prevented, and a stable conveyance of the document sheet can be achieved.

As typically shown in FIG. 7, the first segment 86 of the plate member 85 comprises the extending portions 86A and the reinforcing portion 86B. Because the extending portion 86A has the through hole into which the spring holding portion 77 is inserted, the extending portion 86A reliably contacts one end of the coil spring 90 fitted around the spring holding portion 77. The reinforcing member 86B is formed such that the first segment 86 extends across the entire width of the conveying path R. This increases the rigidity of the plate member 85. As shown in FIGS. 6 and 7, because the extending distance of the reinforcing portion 86B from the second segment 87 of the plate member 85 is less than that of the extending portion 86, the size of the first segment 86 is minimized. Thus, the cost of the plate member 85 can be reduced.

Opposite ends of the first segment 86 of the plate member 85 in the width direction of the document sheet respectively contact the reinforcing ribs 78 that are formed in proximity of the respective side wall portions 71. Because the side wall portions 71 are formed respectively along the opposite ends in the width direction of the top cover 70 and extend toward the conveying path R, the rigidity of portions of the top cover 70 proximate to the side wall portions 71 are greater than that of the remaining portion of the top cover 70. The reinforcing ribs 78, which are formed respectively along the side wall portions 71, further increase the rigidity of the portions of the top cover 70 proximate to the side wall portions 71. Because the reinforcing ribs 78 contact the first segment 86 of the plate member 85, the urging force of the coil springs 90 can be spread to the portions of the top cover 70 having a relatively high rigidity. This can prevents deformation of the top cover due to the urging force of the coil springs 90.

Although, in the above-described embodiment, the sheet conveying device is applied to the multi-function device, the sheet conveying device may be applied to a scanning device comprising an automatic document feeder (ADF).

Although, in the above-described embodiment, the driven conveying roller 80 and the driving conveying roller 62 are configured to sandwich the document sheet and to convey the document sheet along the conveying path R, the driving conveying roller 62 should not necessarily be provided so as to oppose the driven conveying roller 80 via the conveying path R. The driven conveying roller 80 may be replaced with a smooth surface as long as the driven conveying roller 80 is urged toward the conveying path R.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A sheet conveying device comprising:

a cover member made of resin and defining a part of a conveying path along which a sheet is conveyed;

a roller member rotatably disposed on a conveying path facing side of the cover member and configured to convey the sheet along the conveying path, the roller member comprising a rotary shaft;

an urging member disposed between the cover member and the rotary shaft of the roller member and urging the roller member toward the conveying path in a state where one end of the urging member contacts the rotary shaft of the roller member;

a plate member made of metal and disposed between the cover member and the urging member, wherein the plate member comprises:

a first segment extending along a surface of the conveying path facing side of the cover member and contacting an other end of the urging member, a second segment extending from an edge of the first segment in a direction toward the conveying path, and a third segment extending from an edge of the second segment in a direction different from the direction in which the second segment extends; and a main body that defines the conveying path together with the cover member and comprises a driving roller, wherein the urging member urges the roller member toward the driving roller.

2. The sheet conveying device according to claim 1, wherein the third segment extends from the edge of the second segment in a direction toward a downstream side in a sheet conveying direction in which the sheet is conveyed along the conveying path.

3. The sheet conveying device according to claim 1, wherein the cover member comprises:

a positioning portion removably positioning the first segment of the plate member on the conveying path facing side of the cover member, a shaft holding portion rotatably holding the rotary shaft of the roller member at a position separated by a predetermined distance from the positioning portion toward the conveying path, and wherein the roller member is attached to the cover member such that the rotary shaft of the roller member is held by the shaft holding portion while the rotary shaft contacts the one end of the urging member in a state where the other end of the urging member contacts the first segment of the plate member positioned by the positioning portion.

4. The sheet conveying device according to claim 3, wherein the positioning portion comprises a first positioning portion and a second positioning portion, and the shaft holding portion is disposed between the first positioning portion and the second positioning portion in a sheet conveying direction.

5. The sheet conveying device according to claim 1, wherein the first segment of the plate member comprises:

an extending portion extending from the second segment by a predetermined distance and contacting the other end of the urging member, and a reinforcing portion extending from the second segment by a distance less than the predetermined distance.

6. The sheet conveying device according to claim 1, wherein the cover member comprises:

side wall portions disposed respectively at opposite ends of the cover member in a width direction of the sheet conveyed along the conveying path, and projecting toward the conveying path, the width direction being perpendicular to a sheet conveying direction, and reinforcing ribs projecting respectively along the side wall portions and contacting the first segment of the plate member, wherein the first segment extends across the cover member in the width direction.

7. The sheet conveying device according to claim 1, wherein the cover member comprises a positioning portion positioning the plate member relative to the cover member and comprising a first engaging portion, and wherein the plate member comprises a second engaging portion, and the second engaging portion of the plate member positioned by the positioning portion engages with the first engaging portion of the positioning member.

8. The sheet conveying device according to claim 7, wherein the first engaging portion of the positioning portion comprises a holding portion holding the urging member, and the second engaging portion of the plate member has a through hole formed in the first segment of the plate member.

9. The sheet conveying device according to claim 8, wherein the urging member comprises a coil spring that is inserted into the holding portion.

10. The sheet conveying device according to claim 1, wherein the third segment of the plate member is disposed upstream of the roller member in a sheet conveying direction and is exposed to the conveying path such that the third segment guides the sheet to the roller member along the conveying path.

11. The sheet conveying device according to claim 10, wherein the cover member comprises guide ribs projecting toward the conveying path, and projecting ends of the guide ribs are configured to guide the sheet in the sheet conveying direction along the conveying path, and wherein the third segment of the plate member is disposed downstream of the guide ribs in the sheet conveying direction and extends along a direction defined by the projecting ends of the guide ribs.

12. A sheet conveying device comprising:

a cover member made of resin and defining a part of a conveying path along which a sheet is conveyed;

a roller member rotatably disposed on a conveying path facing side of the cover member and configured to convey the sheet along the conveying path, the roller member comprising a rotary shaft;

an urging member disposed between the cover member and the rotary shaft of the roller member and urging the roller member toward the conveying path in a state where one end of the urging member contacts the rotary shaft of the roller member;

a plate member made of metal and disposed between the cover member and the urging member, wherein the plate member comprises:

a first segment extending along a surface of the conveying path facing side of the cover member and contacting an other end of the urging member, a second segment extending from an edge of the first segment in a direction toward the conveying path, and a third segment extending from an edge of the second segment in a direction different from the direction in which the second segment extends; and a main body that defines the conveying path together with the cover member and comprises a driving roller, wherein the urging member urges the roller member toward the driving roller, wherein the third segment extends from the edge of the second segment in a direction toward a downstream side in a sheet conveying direction in which the sheet is conveyed along the conveying path, and wherein the third segment of the plate member is disposed upstream of the roller member in the sheet conveying direction and adjacent to the roller member.

13. A sheet conveying device comprising:

a cover member made of resin and defining a part of a conveying path along which a sheet is conveyed;

a roller member rotatably disposed on a conveying path facing side of the cover member and configured to convey the sheet along the conveying path, the roller member comprising a rotary shaft;

an urging member disposed between the cover member and the rotary shaft of the roller member and urging the roller member toward the conveying path in a state where one end of the urging member contacts the rotary shaft of the roller member;

a plate member made of metal and disposed between the cover member and the urging member, wherein the plate member comprises:

a first segment extending along a surface of the conveying path facing side of the cover member and contacting an other end of the urging member, a second segment extending from an edge of the first segment in a direction toward the conveying path, and a third segment extending from an edge of the second segment in a direction different from the direction in which the second segment extends; and a main body, wherein the cover member is configured to pivot relative to the main body about an axis located at an end of the cover member, the end being upstream of the cover member in a sheet conveying direction.

* * * * *